United States Patent [19]

Iwaki et al.

[11] 4,425,418

[45] Jan. 10, 1984

[54] LIQUID DEVELOPERS FOR ELECTROPHOTOGRAPHY AND DEVELOPING METHOD USING THE SAME

[75] Inventors: Akio Iwaki; Toyoki Nishijima; Akio Iijima; Tatsuya Sasazawa, all of Hino, Japan

[73] Assignee: Konishiroku Photo Industry Co., Ltd., Tokyo, Japan

[21] Appl. No.: 377,585

[22] Filed: May 12, 1982

[30] Foreign Application Priority Data

May 19, 1981 [JP] Japan ..... 56-74107
May 19, 1981 [JP] Japan ..... 56-74108

[51] Int. Cl.[3] ..... G03G 9/12

[52] U.S. Cl. ..... 430/106; 430/114; 430/115

[58] Field of Search ..... 430/112, 114, 118, 106

[56] References Cited

U.S. PATENT DOCUMENTS 3,993,483 11/1976 Maki et al. ..... 430/115 X 4,060,493 11/1977 Tsubuko et al. ..... 430/115 X

FOREIGN PATENT DOCUMENTS 55-164853 12/1980 Japan ..... 430/115

OTHER PUBLICATIONS

Merrill et al., "Liquid Electrographic Developers", Res. Discl. 14337, Mar. 1976, p. 24.

*Primary Examiner*—Roland E. Martin, Jr.
*Attorney, Agent, or Firm*—Frishauf, Holtz, Goodman & Woodward

[57] ABSTRACT

New liquid developers for electrophotography comprise (a) a coloring agent, (b) a charge control agent and (c) one or more of a polyethylene, a polypropylene, an ethylene copolymer and a propylene copolymer, with or without (d) a hydrocarbon resin soluble in a hydrocarbon solvent and containing a 1,3-pentadiene moiety, in an electro-insulating liquid. These developers have an excellent etching resistance and a high dispersion stability.

6 Claims, No Drawings

LIQUID DEVELOPERS FOR ELECTROPHOTOGRAPHY AND DEVELOPING METHOD USING THE SAME

This invention relates to a liquid developer for electrophotography and a developing method using the same. More particularly, it is concerned with a liquid developer for electrophotography which is employed for the development step in a process for preparing a lithographic printing plate according to an electrophotographic method (hereinafter referred to as "liquid developer") and also with a process for developing an original printing plate by the use of the said liquid developer.

Hitherto, there has been employed as a lithographic printing plate the printing plate having coated a photosensitive resin thereon, but this printing plate has exhibited an xtremely lower sensitivity, as compared with silver salt-containing photosensitive materials or electrophotographic materials. Therefore, where a printing plate containing a photosensitive resin is to be exposed, there is usually effected exposure of the said printing plate having contacted therewith a silver salt type photosensitive material prepared according to photomechanical process. Recently, there has been developed a process method wherein a printing plate is prepared through direct copying of an original copy, without employing the photomechanical process step for preparing the so-called silver salt-containing lith film, namely, the silver halide photosensitive material capable of being developed with a lith developer, for the purposes of labor-saving and resources-saving.

More specifically, there is well-known a process for making a printing plate electrophotographically wherein a printing plate is prepared by direct copying of an original copy according to an electrophotographic method. For example, Japanese Patent Publications No. 17162/1962, No. 6961/1963, No. 12703/1964 and so on disclose a method for preparing a printing plate wherein a photoconductive layer is provided over a roughened aluminum plate, a toner image is formed by charging, exposing and developing according to an electrophotographic method and then the photoconductive layer in a non-image portion (namely, the portion having no toner which adheres thereto) is dissolved out with an alkali solution. Moreover, Japanese Provisional Patent Publication No. 144203/1979 discloses a method for preparing a lithographic printing plate wherein a toner image is formed on a zinc oxide photosensitive material according to an electrophotographic method, transferred onto a transfer printing plate composed of an aluminum plate having an epoxy resin layer thereon and, after heat fixing, the epoxy resin layer in a non-image portion is dissolved out with a solvent.

In these prior art techniques in which a dry developer has been used to obtain a toner image according to the electrophotographic method, there is a disadvantage in that an image resolving power is poor. Generally, where a toner image is to be formed according to an electrophotographic method, a wet development has the characteristics of a far more excellent resolving power and a superior image-reproducibility as compared with a dry development. However, any useful wet developer has not been yet proposed for the electrophotographic method involving the step wherein a toner image is formed according to the electrophotographic method and a non-image portion is dissolved away (hereinafter referred to as "etching"). Namely, in preparing a printing plate by forming a toner image through a wet development with a wet developer followed by etching, there is seen such a defect that an imaged portion (the portion having a toner which adheres thereto) also tends to be readily dissolved out and hence the image portion shows a poor etching resistance.

An object of this invention is to provide a liquid developer for producing a printing plate with a high resolving power according to an electrophotographic method and a method for development using the said liquid developer.

A further object of this invention is to provide a liquid developer having an excellent etching resistance in a process for making a printing plate electrophotographically including the etching step and a developing method using the said liquid developer.

A still further object of this invention is to provide a liquid developer having a high stability when dispersed and a method for development with the said liquid developer.

These and other objects and advantages of this invention will be apparent to those skilled in the art from the detailed description as stated hereinbelow.

According to one aspect of this invention, there is provided a new type of a liquid developer which comprises (a) a coloring agent, (b) a charge control agent and (c) one or more of a polyethylene, a polypropylene, an ethylene copolymer and a propylene copolymer in an electro-insulating liquid.

According to another aspect of this invention, there is also provided another type of a liquid developer which comprises the above-defined three components (a), (b) and (c) and further (d) a hydrocarbon resin that is soluble in a hydrocarbon solvent and contains 1,3-pentadiene in an electro-insulating liquid.

According to other aspect of this invention, there is provided a method for preparing a printing plate wherein an original printing plate having a photoconductive layer over the support or substrate thereof is charged to form an electric latent image thereon according to an electrophotographic method, the image is exposed and then developed with a liquid developer to form a toner image and, after fixing, the photoconductive layer in a non-image portion is dissolved out to prepare a printing plate, characterized in that either of the liquid developers of the present invention as defined above is used as the liquid developer for electrophotography in the above development step.

A liquid developer for electrophotography may generally comprise a coloring agent, a coating agent, a charge control agent and a liquid carrier composed of an electro-insulating liquid. As the coating agent which may be employed therein, there may be used, for example, a variety of polymeric compounds such as alkyd resins, acrylic resins, styrene group resins, vinyl chloride resins, polyamide resins, rubbery resins, cyclized rubbers, rosin derivatives and the like. However, where a developer having incorporated therein such resin is applied to an electrophotographic process comprising an etching step, there is seen a defect of a poor etching resistance. In Japanese Patent Publications No. 33777/1975, No. 29653/1976, No. 47338/1976, No. 3582/1977 and Japanese Provional Patent Publication No. 4,9445/1973, there is proposed a liquid developer containing a polyethylene, an ethylene-vinyl acetate copolymer, a polypropylene and the like. However, these prior techniques have been contemplated merely to improve the transferability when a toner image is transferred onto a transfer paper, in a conventional copying.

As explained above, the liquid developer of this invention comprises (a) a coloring agent, (b) a charge control agent and (c) one or more of a polyethylene, a polypropylene, an ethylene copolymer and a propylene copolymer in an electro-insulating liquid. As another embodiment of the present invention, the liquid developer comprises the above-defined three components (a), (b) and (c) and, additionally, (d) a hydrocarbon resin soluble in a hydrocarbon solvent and containing 1,3-pentadiene in an electro-insulating liquid.

The term "ethylene copolymer" as used herein is meant to indicate any of those copolymers of ethylene with one or more other monomers copolymerizable with ethylene, while the term "propylene copolymer" means to indicate any of those copolymers of propylene with one or more other monomers copolymerizable with propylene. As the monomer copolymerizable with ethylene or propylene, there may be mentioned, for example, methyl acrylate, ethyl acrylate, ethyl methacrylate, vinyl acetate, vinyl chloride, tetrafluoroethylene and the like.

A total amount of one or more of polyethylene, polypropylene, ethylene copolymer and propylene copolymer to be added is usually 0.01 to 5 parts by weight, preferably 0.1 to 2 parts by weight, upon 100 parts by weight of the electro-insulating liquid.

Use of the resin can provided a printing plate having an excellent resolving power and an improved etching resistance in an electrophotographic process including an etching step.

As the charge control agent which may be employed in the present invention, there may be mentioned, for example, lecitin, a metal salt of naphthenic acid, an alkylbenzenesulfonate, a dialkylnaphthalenesulfonate, a mono- or dialkylsulfosuccinate, a dialkylphosphate, linseed oil, soybean oil, an alkyd resin and the like. An amount of the agent to the added may be dependent upon the type of the said agent and hence is not always determined clearly. However, it is preferable to select the amount suitably so that electric resistance of the liquid developer may be, for example, $10^9$ Ωcm or higher.

As the coloring agent which may be employed in this invention, there may be employed any pigments or dyes without limitation: For instance, carbon black, copper phthalocianine, phthalocianine green, Malachite Green, Rhodamine, Victoria Blue, Oil Black and so on. An amount of the coloring agent to be added is not critical, but it is usually 0.01 to 1.00 part by weight, preferably 0.01 to 0.1 part by weight, upon 100 parts by weight of the electro-insulating liquid.

As the electro-insulating liquid which may be employed in this invention, one can use any of the electro-insulating liquids (such as aliphatic hydrocarbons, aromatic hydrocarbons, halogenated hydrocarbons) having an electric resistance of not less than $10^9$ Ωcm: For instance, n-pentane, n-hexane, chlorinated paraffin, isoparaffin, kerosine and the like.

In addition, the liquid developer of the present invention may further include other natural or synthetic polymeric compounds, if required.

As the 1,3-pentadiene-containing hydrocarbon resin which is to be employed in another embodiment of the liquid developer of the present invention, there may be mentioned, for example, those resins as described in Japanese Patent Publication No. 29951/1975, the disclosure of which is incorporated herein as reference. Illustrative and commercially available examples of such resin may include, for example, Quintone C-100, C-200, D-200, U-200 (they are manufactured by Nippon Zeon Co., Ltd., Japan) and the like. An amount of the resin to be added is usually 0.01 to 5 parts by weight, preferably 0.1 to 2 parts by weight, upon 100 parts by weight of the electro-insulating liquid. It is to be noted that addition of such a resin can unexpectedly improve dispersibility of toner grains and stability of the dispersion containing toner grains remarkably.

The liquid developer of the present invention may be prepared, for instance, according to one preferable embodiment wherein the above-mentioned components (a), (b) and (c) are added to the electro-insulating liquid with or without the above additional component (d) and the resulting mixture is homogeneously dispersed by means of any conventional techniques such as a ball mill, a sand mill, a colloid mill, a supersonic dispersion method and the like.

The original printing plate to which this process is to be applied has a photoconductive layer on a support and the said photoconductive layer contains an photoconductor. As the photoconductor, there may be employed one or more of any inorganic photoconductors, organic photoconductors and organic photoconductive pigments. The photoconductor can be dissolved or suspended in a solution containing a natural or synthetic polymeric substance and the resultant solution or suspension applied onto an conductive support in a known manner per se to prepare an original printing plate. The original printing plate thus prepared is charged and exposed according to a conventional electrophotographic process, developed with the liquid developer of the present invention, fixed and then the non-image portion or the portion having no toner adhered thereon is subjected to etching with a solvent to prepare a printing plate. As the light source for exposure in the above-mentioned process stage, there may be applied xenon lamp, halogen lamp, fluorescent lamp, tungsten lamp, laser ray, e.g., semi-conductor laser, Ar ion laser, He-Ne laser and the like. As the solvent for etching, there may be optionally selected any of those solvents, depending upon the sort of the photoconductor contained in a photoconductive layer or the binder resin.

Where the liquid developer of the present invention is applied, an imaged portion or the portion having a toner which adheres thereto exhibits an extremely high resistance to the etching solvent during the etching step without any imaged portion dissolved out. Further, the resulting printing plate has a high resolving power and an excellent image reproducibility.

This invention will be more fully illustrated by way of the following Examples, but these Examples are not construed to be limiting the scope of this invention. All parts are by weight unless otherwise indicated.

EXAMPLE 1

| | |
|---|---|
| ε-type Copper phthalocyanine | 1 part |
| m-Cresol phenol-novolak resin | 6 parts |
| Ethylene glycol monoethyl ether | 24 parts |

A composition having the above formulation was dispersed and homogenized at ordinary temperature by means of a supersonic dispersion mixer. The resulting photosensitive liquid was coated onto a roughened aluminum plate with a film thickness of 5μ to prepare a printing original plate.

| | |
|---|---|
| Carbon black | 1 part |
| Ethylene-ethyl acrylate copolymer (ethylene: ethyl acrylate = 72:28) | 3 parts |
| Manganese naphthenate | 0.05 part |
| Isopar G (manufactured by Esso Petrochemical Co., Ltd., phosphate type surface active agent) | 40 parts |

On the other hand, the above mixture was dispersed in a porcelain ball mill for 24 hours and one part of the so obtained dispersion was added to 10 parts of Isopar G while stirring to produce a liquid developer.

Then, the printing original plate thus prepared was charged with negative by means of a corona discharger, a reflection positive was used as an original copy and fluorescent lamp (20 W×10) as a light source and then image exposure was made through lens system to for an electrostatic latent image, which was developed with the above-mentioned liquid developer. After fixing with heating, the plate was dipped into an alkali aqueous solution consisting of sodium silicate and sodium hydroxide to accomplish etching of the photoconductive layer in a non-imaged portion, namely, the portion having no toner adhered, thereby providing a printing plate. This printing plate has an excellent resolving power as demonstrated in the following Table 1.

EXAMPLE 2

| | |
|---|---|
| Carbon black | 1 part |
| Polyethylene (M.W. 1,500) | 3 parts |
| Gafac RB-410 (manufactured by Toho Chemical Co., Ltd., phosphate type surface active agent) | 0.05 part |
| Isopar G | 40 parts |

Following the same procedures as in Example 1 except that the above mixture was used, there was prepared a liquid developer.

Then, the same procedure as in Example 1 was repeated except that the same original printing plate as in Example 1 was charged with positive by means of a corona discharger to form a printing plate. This plate has an excellent resolving power as demonstrated in the following Table 1.

EXAMPLE 3

| | |
|---|---|
| Phthalocyanine blue | 1 part |
| Ethylene-vinyl acetate copolymer (ethylene:vinyl acetate = 72:28) | 4 parts |
| Isopar G | 40 parts |

The above mixture was dispersed by means of a porcelain ball mill for 24 hours and one part of the dispersion was added with stirring to 10 parts of Isopar G containing 0.01% by weight of iron naphthenate to form a liquid developer.

Then, the same original printing plate as in Example 1 was charged with positive by means of a corona discharger, macro-photography to 16-fold area ratio was effected using a micro-film as an original copy and a commercially available photographic enlarger and the plate was developed with the aforesaid liquid developer. Subsequently, the same treatment as in Example 1 gave a printing plate having an excellent resolving power as demonstrated in the following Table 1.

EXAMPLE 4

| | |
|---|---|
| 2,5-Bis[4'-diethylaminophenyl-(1')]-1,3,4-oxadiazole | 10 parts |
| Styrene-maleic anhydride copolymer (styrene:maleic anhydride = 1:1) | 10 parts |
| Rhodamine B | 0.005 part |
| Ethylene glycol monoethyl ether | 40 parts |

The above composition was coated onto a roughened aluminum plate with a film thickness of 8μ to form an original printing plate.

| | |
|---|---|
| Carbon black | 1 part |
| Polypropylene (M.W. 4,000) | 3 parts |
| Sodium laurylbenzenesulfonate | 0.05 part |
| Isopar G | 40 parts |

On the other hand, the above mixture was dispersed by means of a porcelain ball mill for 24 hours and one part of the dispersion was added with stirring to 15 parts of Isopar G to prepare a liquid developer.

Then, the same treatment as in Example 2 was effected, except that the above-mentioned original printing plate was used, to give a printing plate having an excellent resolving power as demonstrated in the following Table 1.

In order to show effect of this invention more definitely, the results from the above examples are summarized in the following Table 1, with those from Comparative Examples.

TABLE 1

| | Resolving power (line/mm) | Etching resistance |
|---|---|---|
| Example 1 | 20 | Good |
| Comparative Example 1 | 6 | " |
| Example 2 | 20 | " |
| Comparative Example 2 | — | Image portion dissolved out |
| Example 3 | 15 | Good |
| Comparative Example 3 | — | Image portion dissolved out |
| Example 4 | 20 | Good |
| Comparative Example 4 | — | Image portion dissolved out |

[Notes]
Process conditions:
Fixing; heat treatment in an oven at 100° C. for 1 min.
Etching; 7-fold dilution of SDP-1 (developer for PS plate manufactured by Konishiroku Photo Ind. Co., Ltd.)

The above-mentioned Comparative Examples are illustrated below.

Comparative Example 1

Following the same procedure as in Example 1 except that a polystyrene type toner powder was employed, there was produced a printing plate.

Comparative Example 2

| | |
|---|---|
| Carbon black | 1 part |
| Coumaron resin | 3 parts |
| Gafac RB-410 | 0.05 part |

-continued

| | |
|---|---|
| Isopar G | 40 parts |

Following the same procedure as in Example 1 except that the above-defined mixture was employed, there was prepared a liquid developer. Then, the same treatment as in Example 2 was effected except that the developer obtained as above was used.

Comparative Example 3

| | |
|---|---|
| Phthalocyanine blue | 1 part |
| 50% (by weight) Styrene-diethylaminoethyl methacrylate (95:5) solution in toluene | 8 parts |
| Iron naphthenate | 0.05 part |
| Isopar G | 40 parts |

Following the same procedure as in Example 3 except that the above-defined mixture was employed, there was prepared a liquid developer. Then, the same treatment as in Example 3 was effected.

Comparative Example 4

| | |
|---|---|
| Carbon black | 1 part |
| 20% (by weight) Cyclized rubber solution in toluene | 15 parts |
| Sodium laurylbenzenesulfonate | 0.05 part |
| Isopar G | 40 parts |

Folloring the same procedure as in Example 4 except that the above-defined mixture was used, there was prepared a liquid developer. Then, the same treatment as in Example 4 was effected.

EXAMPLE 5

By using the same procedure and composition as in Example 1, there was prepared an original printing plate.

| | |
|---|---|
| Carbon black | 1 part |
| Ethylene-ethyl acrylate (72:28) copolymer | 3 parts |
| Quintone C-200 (manufactured by Nippon Zeon Co., Ltd.) | 1 part |
| Manganese naphthenate | 0.05 part |
| Isopar G | 40 parts |

The above mixture was treated in the same manner as in Example 1 to prepare a liquid developer.

The printing plate was treated with the developer in the same manner as in Example 1 to form a printing plate having an excellent resolving power as demonstrated in the following Table 2.

EXAMPLE 6

| | |
|---|---|
| Carbon black | 1 part |
| Polyethylene (M.W. 1,500) | 3 parts |
| Quintone C-200 | 3 parts |
| Gafac RB-410 (manufactured by Toho Chemical Co., Ltd., phosphate type surface active agent) | 0.05 part |
| Isopar G | 40 parts |

The same procedure as in Example 1 except that the above mixture was used were repeated to prepare a liquid developer.

Then, the same procedure as in Example 1 was repeated to give a printing plate having an excellent resolving power as demonstrated in the following Table 2.

EXAMPLE 7

| | |
|---|---|
| Phthalocyanine blue | 1 part |
| Ethylene-vinyl acetate (72:28) copolymer | 4 parts |
| Quintone D-200 (manufactured by Nippon Zeon Co., Ltd.) | 2 parts |
| Isopar G | 40 parts |

Following the same procedure as in Example 3 except that the above mixture was used, there was prepared a printing plate having an excellent resolving power as demonstrated in the following Table 2.

EXAMPLE 8

The original printing plate was prepared according to the same procedure as in Example 4.

| | |
|---|---|
| Carbon black | 1 part |
| Polypropylene | 3 parts |
| Quintone C-100 (manufactured by Nippon Zeon Co., Ltd.) | 1 part |
| Phoslex A-12 (manufactured by Sakai Kagaku K.K., phosphate type surface active agent) | 0.05 part |
| Isopar G | 40 parts |

The liquid developer was prepared from the above mixture according to the same procedure as in Example 4.

By using the original plate and developer in the same manner as in Example 4, there was prepared a printing plate having an excellent resolving power as demonstrated in the following Table 2.

In order to show effect of this invention more fully, the results from the above Examples are summarized in the following Table 2 with those from Comparative Examples.

TABLE 2

| | Stability of dispersed developer | Etching resistance | Resolving power (line/mm) |
|---|---|---|---|
| Example 5 | Good | Good | 20 |
| Comparative Example 5 | — | " | 6 |
| Example 6 | Good | " | 20 |
| Comparative Example 6 | " | Image portion dissolved out | — |
| Example 7 | " | Good | 15 |
| Comparative Example 7 | Aggregated and precipitated | " | 15 |
| Example 8 | Good | " | 20 |
| Comparative Example 8 | Aggregated and | " | 20 |

TABLE 2-continued

| | Stability of dispersed developer | Etching resistance | Resolving power (line/mm) |
|---|---|---|---|
| | precipitated | | |

[Notes]
Process conditions:
Fixing; heat treatment in an oven at 100° C. for 1 min.
Etching; 7-fold dilution of SDP-1 (developer for PS plate manufactured by Konishiroku Photo Ind. Co., Ltd.)
Stability of dispersed developer; 2-fold diluted liquid developer allowed to stand over one week The above-mentioned Comparative Examples are illustrated below.

Comparative Example 5

Following the same procedure as in Example 5 except that a polystyrene type powdery toner was employed, there was prepared a printing plate.

Comparative Example 6

| | |
|---|---|
| Carbon black | 1 part |
| Coumarone resin | 3 parts |
| Gafac RB-410 | 0.05 part |
| Isopar G | 40 parts |

Following the same procedure as in Example 5 except that the above mixture was employed, there was prepared a liquid developer and subsequently processing was effected in the same manner as Example 6.

Comparative Example 7

| | |
|---|---|
| Phthalocyanine blue | 1 part |
| Ethylene-vinyl acetate (72:28) copolymer | 4 parts |
| Maleic acid-modified rosin | 2 parts |
| Isopar G | 40 parts |

Following the same procedure as in Example 7 except that the above mixture was employed, there was prepared a liquid developer and then processing was effected.

Comparative Example 8

| | |
|---|---|
| Carbon black | 1 part |
| Polypropylene | 3 parts |
| 20% (by weight) Cyclized rubber solution in toluene | 5 parts |
| Sodium laurylbenzenesulfonate | 0.05 part |
| Isopar G | 40 parts |

Following the same procedure as in Example 8 except that the above mixture was employed, there was prepared a liquid developer and then processing was effected.

EXAMPLES 9–14

Following the same procedure as in Example 2 except that the high molecular compounds shown below were used instead of polyethylene, there were prepared printing plates.

The results are summarized in Table 3 together with those of the Comparative Examples mentioned hereinafter.

| | |
|---|---|
| Example 9: | Ethylene - vinyl chloride (80:20) copolymer |
| Example 10: | Ethylene - vinyl acetate - vinyl chloride (80:10:10) copolymer |
| Example 11: | Ethylene - tetrafluoroethylene (80:20) copolymer |
| Example 12: | Ethylene - vinyl chloride - dichloroethylene copolymer (i.e., chlorinated polyethylene polymer) |
| Example 13: | Ethylene - butyl acrylate (80:20) copolymer |
| Example 14: | Propylene - vinyl chloride (80:20) copolymer |

Comparative Examples 9–51

Following the same procedure as in Example 1 except that the high molecular compounds shown below were used instead of a copolymer of ethylene and ethyl acrylate (ethylene:ethyl acrylate=72:28), there were prepared printing plates.

The results are summarized in Table 3.

| | |
|---|---|
| Comparative Example 9: | Poly(methyl acrylate) |
| Comparative Example 10: | Poly(methyl methacrylate) |
| Comparative Example 11: | Poly(ethyl acrylate) |
| Comparative Example 12: | Poly(propyl acrylate) |
| Comparative Example 13: | Poly(butyl acrylate) |
| Comparative Example 14: | Poly(hexyl acrylate) |
| Comparative Example 15: | Poly(heptyl acrylate) |
| Comparative Example 16: | Poly(octyl acrylate) |
| Comparative Example 17: | Poly(stearyl acrylate) |
| Comparative Example 18: | Poly(ethyl methacrylate) |
| Comparative Example 19: | Poly(propyl methacrylate) |
| Comparative Example 20: | Poly(butyl methacrylate) |
| Comparative Example 21: | Poly(amyl methacrylate) |
| Comparative Example 22: | Poly(2-hydroxyethyl methacrylate) |
| Comparative Example 23: | Poly(glycidyl methacrylate) |
| Comparative Example 24: | Poly(2-chloroethyl methacrylate) |
| Comparative Example 25: | Polystyrene |
| Comparative Example 26: | Poly(methyl styrene) |
| Comparative Example 27: | Styrene-methyl methacrylate (8:2) copolymer |
| Comparative Example 28: | Styrene-ethyl methacrylate (8:2) copolymer |
| Comparative Example 29: | Styrene-N—diethylaminoethyl methacrylate (8:2) copolymer |
| Comparative Example 30: | Stylene-methacrylic acid (8:2) copolymer |
| Comparative Example 31: | Poly(acrylamide) |
| Comparative Example 32: | Poly(methacrylamide) |
| Comparative Example 33: | Poly(methylolmethacrylamide) |
| Comparative Example 34: | Poly(N—ethylacrylamide) |
| Comparative Example 35: | Poly(N—hydroxyethylmethacrylamide) |
| Comparative Example 36: | Poly(N—phenylacrylamide) |
| Comparative Example 37: | Poly(methyl vinyl ketone) |
| Comparative Example 38: | Poly(ethyl vinyl ketone) |
| Comparative Example 39: | Poly(N—vinyl carbazole) |
| Comparative Example 40: | Poly(N—vinyl pyrrolidone) |
| Comparative Example 41: | Poly(N—vinyl pyridine) |
| Comparative Example 42: | Phenol-novolak resin |
| Comparative Example 43: | Methacresol-novolak resin |
| Comparative Example 44: | Cellulose |
| Comparative Example 45: | Ethylcellulose |
| Comparative Example 46: | Carboxymethylcellulose |
| Comparative Example 47: | Rosin |
| Comparative Example 48: | Terpene polymer |
| Comparative Example 49: | α-pinen resin |
| Comparative Example 50: | Asphalt |
| Comparative Example 51: | Gam arabic |

Comparative Examples 52–84

Following the same procedure as in Example 2 except that the high molecular compounds shown below were used instead of polyethylene, there were prepared printing plates.

The results are summarized in Table 3.

| | |
|---|---|
| Comparative Example 52: | Polyester |
| Comparative Example 53: | Polyamide |
| Comparative Example 54: | Poly(vinyl chloride) |
| Comparative Example 55: | Poly(ethyl vinyl ether) |
| Comparative Example 56: | Poly(2-chloroethyl vinyl ether) |
| Comparative Example 57: | Poly(butyl vinyl ether) |
| Comparative Example 58: | Poly(octyl vinyl ether) |
| Comparative Example 59: | Polyacrylonitrile |
| Comparative Example 60: | Polymethacrylonitrile |
| Comparative Example 61: | Methyl methacrylate-methacrylic acid (9:1) copolymer |
| Comparative Example 62: | Butyl acrylate-N—diethylaminoethyl methacrylate (7:3) copolymer |
| Comparative Example 63: | Lauryl methacrylate-N—diethylaminoethyl methacrylate (7:3) copolymer |
| Comparative Example 64: | Lauryl methacrylate-acrylamide (7:3) copolymer |
| Comparative Example 65: | Lauryl methacrylate-aminostyrene (7:3) copolymer |
| Comparative Example 66: | Lauryl methacrylate-vinylpyridine (7:3) copolymer |
| Comparative Example 67: | Lauryl methacrylate-N—vinylpyrrolidone (7:3) copolymer |
| Comparative Example 68: | Lauryl methacrylate-N—vinylcarbazole (7:3) copolymer |
| Comparative Example 69: | Lauryl methacrylate-N—ethylacrylamide (7:3) copolymer |
| Comparative Example 70: | Lauryl methacrylate-N—phenylmethacrylamide (7:3) copolymer |
| Comparative Example 71: | Lauryl methacrylate-methyl vinyl ether (8:2) copolymer |
| Comparative Example 72: | Lauryl methacrylate-2-chlorethyl vinyl ether (8:2) copolymer |
| Comparative Example 73: | Lauryl methacrylate-octyl vinyl ether (8:2) copolymer |
| Comparative Example 74: | Stearyl acrylate-glycidyl methacrylate (8:2) copolymer |
| Comparative Example 75: | Stearyl acrylate-2-hydroxyethyl methacrylate (8:2) copolymer |
| Comparative Example 76: | Stearyl acrylate-maleic acid anhydride (9:1) copolymer |
| Comparative Example 77: | Stearyl acrylate-acrylonitrile (8:2) copolymer |
| Comparative Example 78: | Stearyl acrylate-methacrylonitrile (8:2) copolymer |
| Comparative Example 79: | Hydroxyethyl cellulose |
| Comparative Example 80: | Alkyd resin |
| Comparative Example 81: | Ester gum |
| Comparative Example 82: | β-pinene resin |
| Comparative Example 83: | Terpene-phenol resin |
| Comparative Example 84: | Xylene-formaldehyde resin |

TABLE 3

| | Resolving Power (line/mm) | Etching Resistance |
|---|---|---|
| Example 9 | 20 | Good |
| Example 10 | 15 | " |
| Example 11 | 15 | " |
| Example 12 | 20 | " |
| Example 13 | 20 | " |
| Example 14 | 20 | " |
| Comparative Examples 9–21 | — | Image portion dissolved out |
| Comparative Examples 22–29 | 8–10 | Good |
| Comparative Examples 30–51 | — | Image portion dissolved out |
| Comparative Examples 52–60 | 8–10 | Good |
| Comparative Example 61 | — | Image portion dissolved out |
| Comparative Examples 62, 63 | 8–10 | Good |
| Comparative Example 64 | — | Image portion dissolved out |
| Comparative Examples 65, 66 | 8–10 | Good |
| Comparative Example 67 | — | Image portion dissolved out |
| Comparative Examples 68–75 | 8–10 | Good |
| Comparative Example 76 | — | Image portion dissolved out |
| Comparative Examples 77, 80 | 8–10 | Good |
| Comparative Examples 78, 79, 81–84 | — | Image portion dissolved out |

We claim:

1. A liquid developer for electrophotography which comprises (a) a coloring agent, (b) a charge control agent, (c) at least one polymer selected from the group consisting of a polyethylene, a polypropylene, an ethylene copolymer and a propylene copolymer in an electro-insulating liquid and (d) a hydrocarbon resin that is soluble in a hydrocarbon solvent and contains a 1,3-pentadiene moiety.

2. A developer according to claim 1 wherein said coloring agent (a) is selected from the group consisting of carbon black, copper phthalocyanine, phthalocyanine green, Malachite Green, Rhodamine, Victoria Blue and Oil Black; said charge control agent (b) is selected from the group consisting of lecithin. a metal salt of naphthenic acid, an alkylbenzenesulfonate, a dialkylnaphthalenesulfonate, a mono- or dialkylsulfosuccinate, a dialkylphosphate, linseed oil, soybean oil and an alkyd resin; said polymer (c) is selected from the group consisting of a polyethylene, a polypropylene, a copolymer of ethylene with a copolymerizable monomer therewith and a copolymer of propylene with a copolymerizable monomer therewith; and said electro-insulating liquid is selected from the group consisting of an aliphatic hydrocarbon, an aromatic hydrocarbon and a halogenated hydrocarbon, said hydrocarbon having an electrical resistance of at least $10^9$ Ωcm.

3. A developer according to claim 1 wherein said coloring agent (a) is in an amount of 0.01 to 1.00 part by weight based upon 100 parts by weight of said insulating liquid, said charge control agent (b) is in an amount sufficient to bring the electrical resistance of said developer to at least $10^9$ Ωcm and said polymer (c) is in an amount of 0.01 to 5 parts by weight based upon 100 parts by weight of said insulating liquid.

4. A developer according to claim 1 wherein said coloring agent (a) is in an amount of 0.01 to 0.1 part by weight based upon 100 parts by weight of said insulating liquid and said polymer (c) is in an amount of 0.1 to 2 parts by weight based upon 100 parts by weight of said insulating liquid.

5. A developer according to claim 1 wherein said hydrocarbon resin (d) is in an amount of 0.01 to 5 parts by weight based upon 100 parts by weight of said insulating liquid.

6. A developer according to claim 5 wherein said hydrocarbon resin (d) is in an amount of 0.1 to 2 parts by weight based upon 100 parts by weight of said insulating liquid.

* * * * *